US006443372B1

(12) United States Patent
Hsu

(10) Patent No.: US 6,443,372 B1
(45) Date of Patent: Sep. 3, 2002

(54) ADJUSTABLE SPRINKLER NOZZLE

(76) Inventor: Tsao-Hui Hsu, No. 34, Lane 357, Sec. 2, Nan Shan Rd., Lu Chu Hsiang, TaoYuan Hsien (TW)

( * ) Notice: Subject to any disclaimer, the term of this patent is extended or adjusted under 35 U.S.C. 154(b) by 43 days.

(21) Appl. No.: 09/734,169

(22) Filed: Dec. 12, 2000

(51) Int. Cl.[7] ..... B05B 1/32

(52) U.S. Cl. ..... 239/457; 239/460; 239/513; 239/514; 239/DIG. 1

(58) Field of Search ..... 239/456, 457, 239/460, 505, 513, 514, 515, 539, DIG. 1

(56) References Cited

U.S. PATENT DOCUMENTS 6,145,758 A * 11/2000 Ogi et al. ..... 239/457
6,264,117 B1 * 7/2001 Roman ..... 239/201

* cited by examiner

*Primary Examiner*—Lesley D. Morris
*Assistant Examiner*—Christopher Kim
(74) *Attorney, Agent, or Firm*—Rosenberg, Klein & Lee

(57) ABSTRACT

An adjustable sprinkler nozzle includes a cap with a first spiraling face, the bottom edge of which is provided with a stepped flange. A body that forms a nozzle orifice with the cap is composed of upper and lower bodies coupled together using high frequencies such that the upper body, during injection molding, is formed with a third spiraling face that extends from an inner tubular wall thereof to correspond to a second spiraling face on the outer periphery. The inner diameter of the third spiraling face can just be fitted into by the larger outer diameter of the stepped flange of the cap. Furthermore, a longitudinal drop face formed between the high and low planes of the third spiraling face is provided with a first stop piece projecting upwardly from a highest point thereof The stop piece is inwardly provided with an inclined face. The inner wall surface of the third spiraling face is provided with a second stop piece relative to the position of the first stop piece.

1 Claim, 13 Drawing Sheets

ADJUSTABLE SPRINKLER NOZZLE

BACKGROUND OF THE INVENTION 1. (a) Field of the Invention

The present invention relates to an improved sprinkler nozzle, more particularly to an adjustable sprinkler nozzle that is adjustable up to 360 degrees.

2. (b) Description of the Prior Art

U.S. Pat. No. 4,579,285 discloses an adjustable sprinkler system (S), which, as shown in FIGS. 16 to 18, comprises an outer tube 6, an inner tube 7, a cap 8 and a screw bolt 9. The upper edge of the inner tube 7 is provided with a spiraling edge 71, and the bottom edge of the cap 8 is correspondingly provided with a spiraling edge 81, thereby forming an adjustable nozzle with a variable outlet orifice. By rotating the cap 8 to displace upwardly and downwardly within the inner tube 7, the flow and speed of the water can be controlled. However, such a sprinkler system (S) has the following drawbacks:

1. Since the water that flows via the bottom portion of the outer tube 6 into a passage 72 is ejected from the outlet orifice between the spiraling edges 81, 71 between the cap 8 and the inner tube 7, the water will flow along the inclined face of the spiraling edges and is sprinkled to the surrounding by a radial force (P1). However, since the spiraling flow of water is not barred in the lateral directions, a larger water jet (W) will be formed at a longitudinal drop face 82 between the higher face and the lower face of the spiraling edge 81, as shown in FIG. 18, thereby resulting in uneven sprinkling of water.

2. Furthermore, to turn off the sprinkler system (S), the cap has to be rotated downwardly so that the spiraling edge 81 abuts against the spiraling edge 71 of the inner tube 7. However, since there is a drop face between the spiraling edges 81, 71, a gap may be present between the abutting spiraling edges 81, 71 during closing, thereby resulting in water leakage.

In U.S. Pat. No. 5,556,036 entitled "Adjustable Arc Sprinkler Nozzle," in order to improve the above-mentioned drawbacks, with reference to FIGS. 19 and 20, a stop member 83 is disposed at the outer periphery of a longitudinal drop face 82 at the joint of a spiraling edge 81 of a cap 8 to provide a lateral force to thereby prevent the formation of a larger water jet (W) at the drop face 82 associated with the prior art shown in FIG. 18. Hence, when the water is sprayed in radial directions (P1), some of the radially flowing water will be blocked by the stop member 83, thereby forming a dead angle of θ degrees. As such, 360-degree sprinkling cannot be achieved.

SUMMARY OF THE INVENTION

The primary object of the invention is to provide an adjustable sprinkler nozzle that is adjustable up to 360 degrees and that does not have any dead angle.

Another object of the invention is to provide an adjustable sprinkler nozzle that utilizes a stepped flange provided at a lower end of a first spiraling face of a cap to abut against an inner wall of a third spiraling face of an upper body to control speed and flow of water, and to ensure complete closing of the nozzle during closing so as to prevent water leakage.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
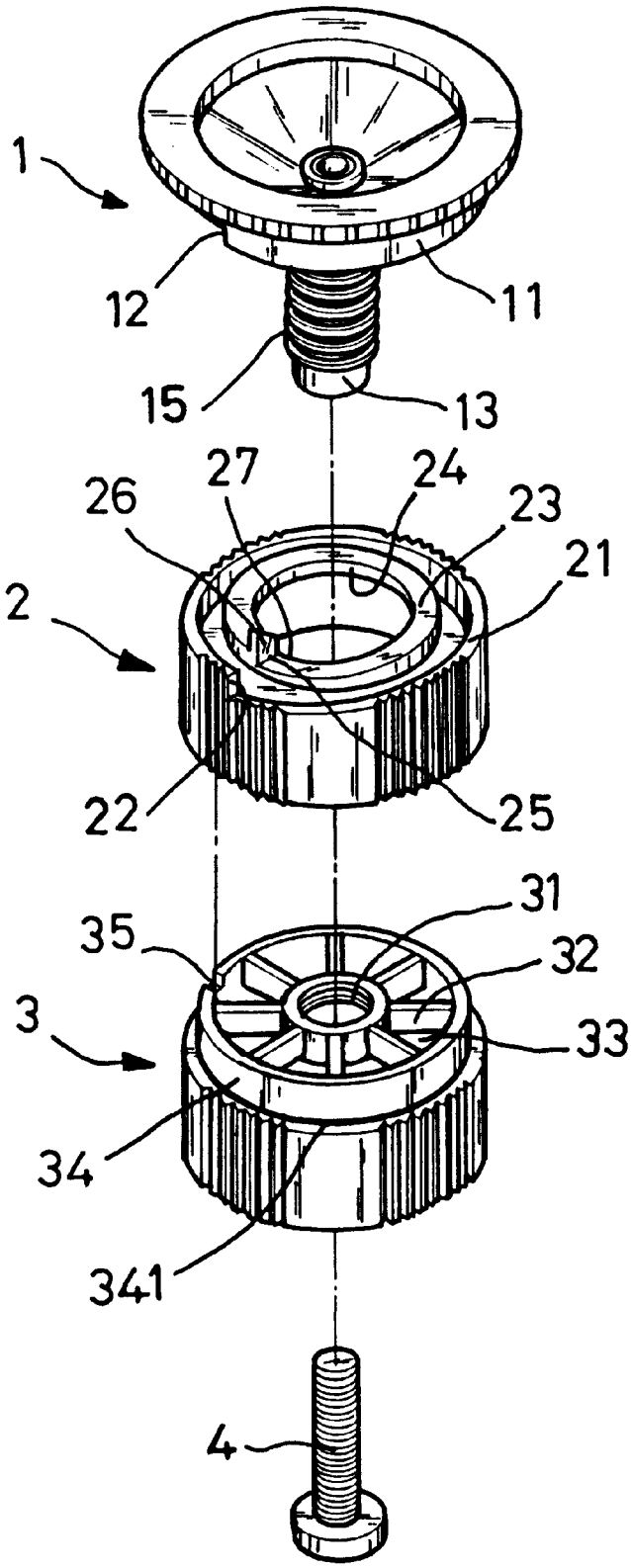
FIG. 1 is an exploded perspective view of the present invention.

With reference to FIG. 1, an adjustable sprinkler nozzle according to this invention includes a cap 1 having a bottom edge provided with a first spiraling face 11 (see FIG. 2) the high and low curved face of which spirals about 360 degrees and then forms a longitudinal drop face 12 at the joint between the high and low planes. An upper body 2, which is a generally hollow tube, has a tubular wall with an upper edge provided with a second spiraling face 21 and a longitudinal drop face 22 corresponding to the first spiraling face 11. A tubular lower body 3 is coupled to the bottom end of the upper body 2 by using high frequencies, and is centrally provided with a threaded portion 31 and a plurality of partitioning plates 32. A channel 33 is formed between adjacent ones of the partitioning plates 32 for passage of the water. A screw bolt 4 is inserted upwardly and locked in a cylindrical tube 13 at the bottom end of the cap 1. A sprinkler can thus be assembled from the above-described components. As the aforesaid belongs to the prior art and is not the subject matter of this invention, a detailed description is not given herein.

Figure 2:
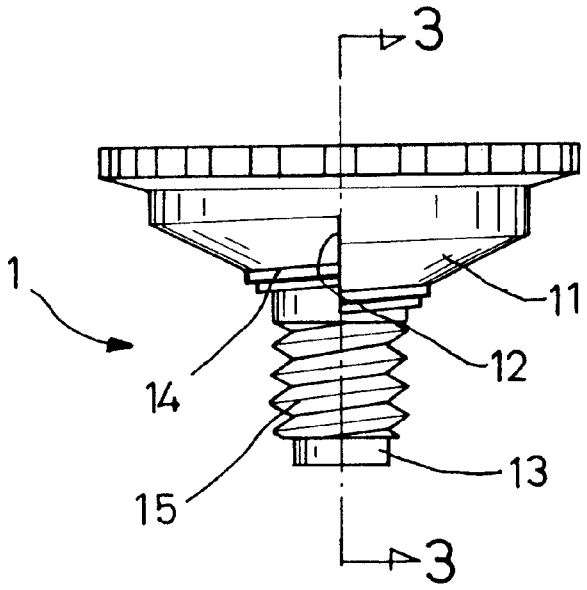
FIG. 2 is a front elevation view of a cap of the present invention.
Figure 3:
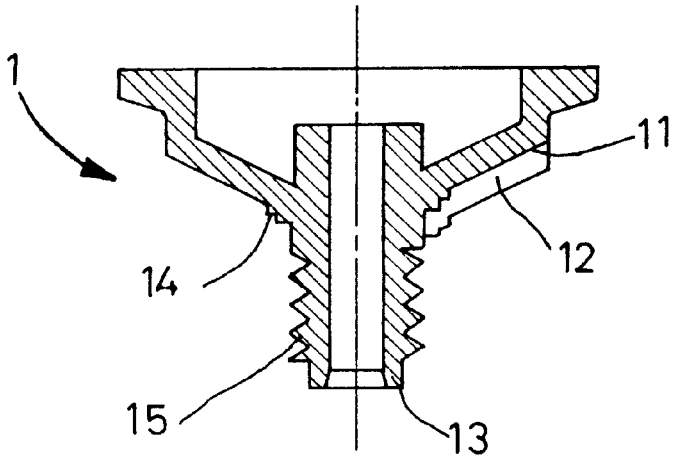
FIG. 3 is a schematic sectional view taken along line 3—3 of FIG. 2.
Figure 4:
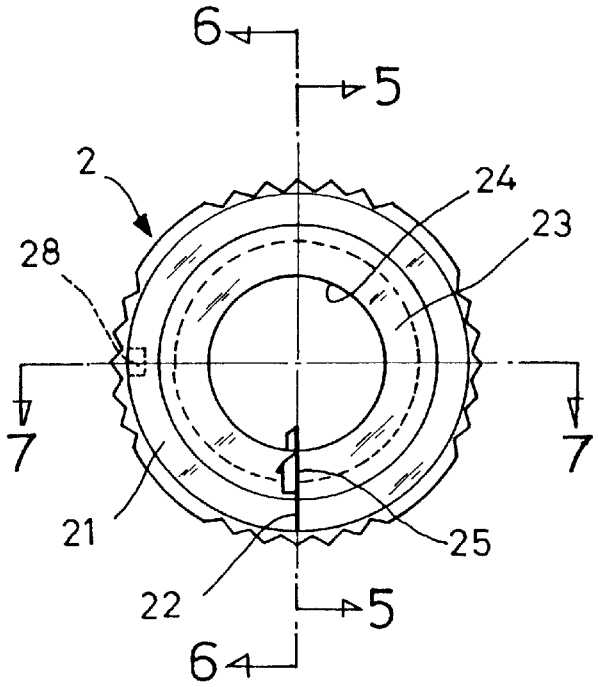
FIG. 4 is a top view of an upper body of the present invention.
Figure 5:
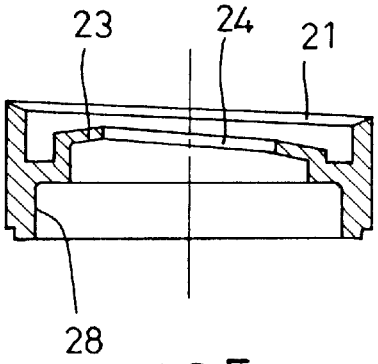
FIG. 5 is a schematic sectional view taken along line 5—5 of FIG. 4.

The improvement provided by this invention is described as follows:

With reference to FIGS. 2 and 3, the cap 1 is provided with a stepped projecting flange 14 along the bottom edge of the first spiraling face 11. The outer periphery of the tube 13 at the bottom end of the cap 1 is directly formed to be a threaded member 15 that can be coupled with the threaded portion 31 of the lower body 3.

Figure 6:
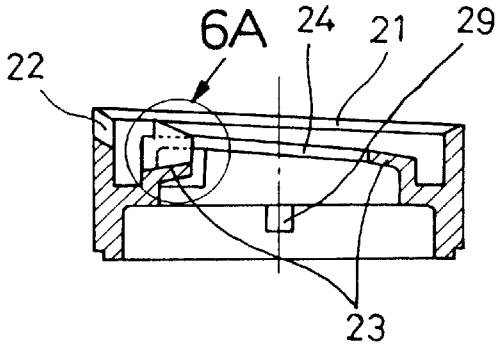
FIG. 6 is a schematic sectional view taken along line 6—6 of FIG. 4.
Figure 7:
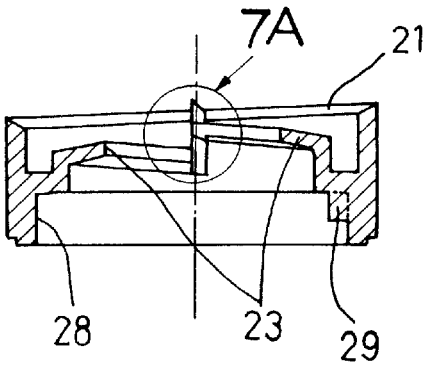
FIG. 7 is a schematic sectional view taken along line 7—7 of FIG. 4.
Figure 6A:
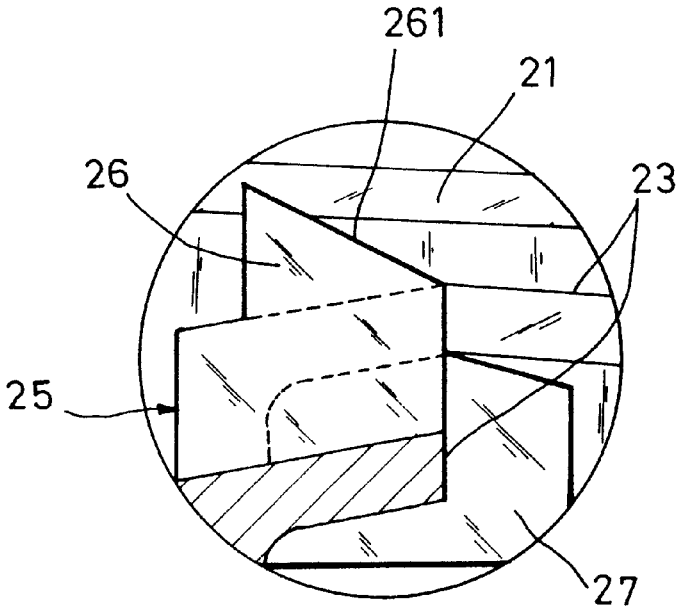
FIG. 6A is a partly enlarged view.
Figure 7A:
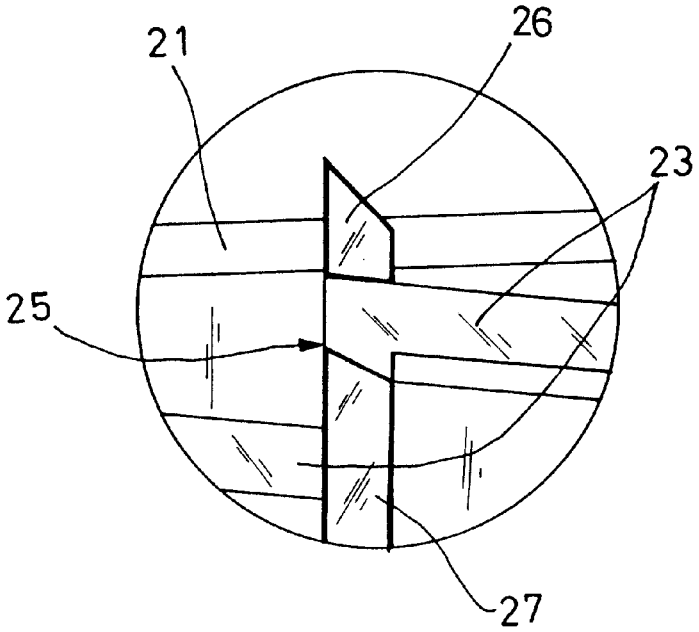
FIG. 7A is a partly enlarged view.

As shown in FIG. 1 and FIGS. 4 to 7, the tubular wall of the upper body 2 proximate to the upper end face thereof extends inwardly to form a third spiraling face 23 corresponding to the second spiraling face 21 and having an inner diameter 24 that can just be fitted into by the larger outer diameter of the stepped flange 14 of the cap 1. In addition, a longitudinal drop face 25 formed at the high and low planes of the third spiraling face 23 has a first stop piece 26 extending upwardly from a highest point of the spiraling face 23. The stop piece 26 is inwardly provided with an inclined face 261, as shown in FIG. 6A. furthermore, relative to the position of the first stop piece 26, the inner wall surface of the third spiraling face 23 is provided with a second stop piece 27. Additionally, as shown in FIG. 6, an inner tubular wall 28 of the upper body 2 is provided with a positioning projecting block 29 at a predetermined position.

Figure 8:
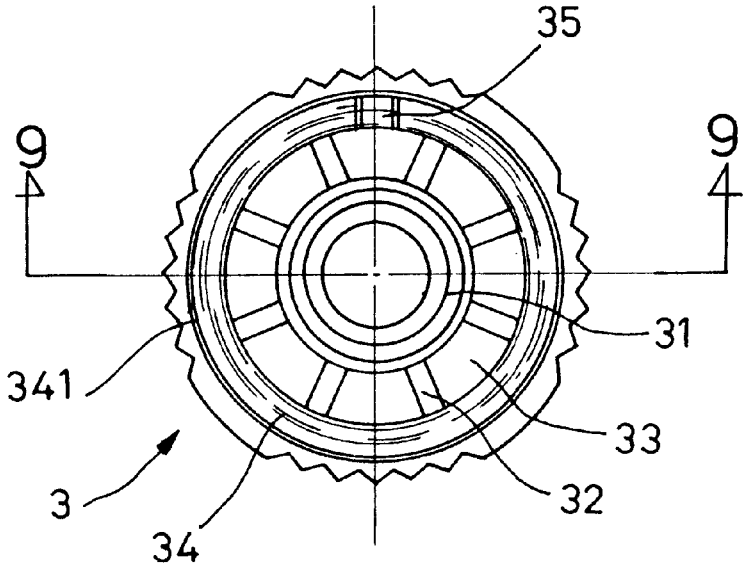
FIG. 8 is a top view of a lower body of the present invention.
Figure 9:
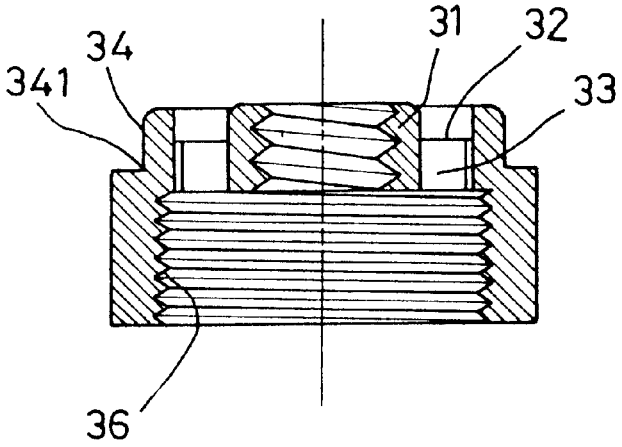
FIG. 9 is a schematic view taken along line 9—9 of FIG. 8.

As shown in FIGS. 8 and 9, an upper end portion of the lower body forms a raised annular portion 34 that can fit into the inner tubular wall 28 of the upper body 2. The bottom edge of the annular portion 34 is formed with a fine annular rib 341 adapted for fusion using high frequencies. Furthermore, the annular portion 34 is provided with a groove 35 at a predetermined position for engaging the projecting block 29 of the upper body 2, and its tubular wall is provided with a threaded member 36.

The screw bolt 4 is locked in the tube 13 of the cap 1 and is rotatable on the threaded portion 3 with the threaded member 15.

Figure 10:
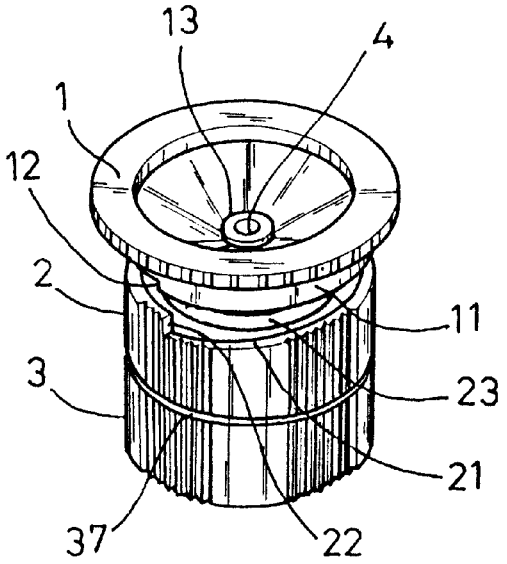
FIG. 10 is a perspective view illustrating assembly of the present invention.
Figure 11:
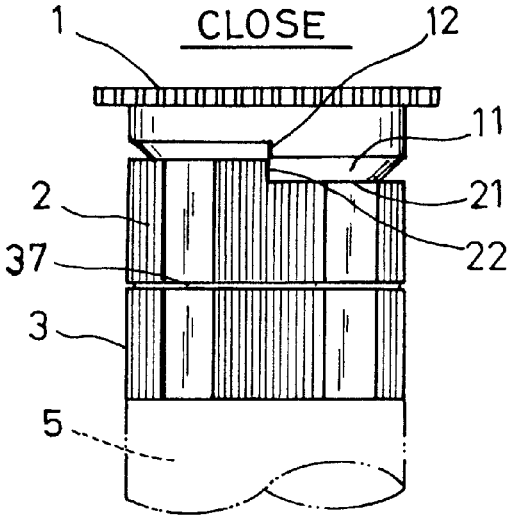
FIG. 11 is a front elevation view of the invention after assembly, in a close state.
Figure 12:
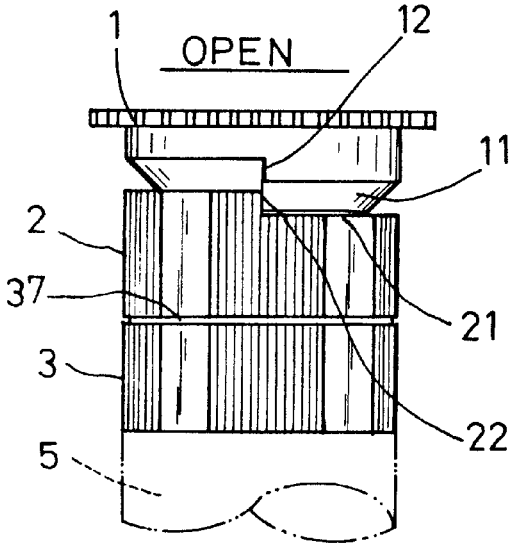
FIG. 12 is a front elevation view of the invention after assembly, in an open state.

FIG. 10 illustrates the invention after assembly. FIG. 11 shows the invention is a close state. At this time, the longitudinal drop face 12 of the first spiraling face 11 of the cap 1 is aligned with the longitudinal drop face 22 of the second spiraling face 21 of the upper body 2. Further, when the cap 1 is rotated upwardly from 0 degree to 360 degrees, with the increase of the rotational angle, the nozzle orifice between the cap land the upper body 2 becomes larger. FIG. 12 shows the cap 1 after being rotated 360 degrees. At this time, the cap 1 elevates the threaded member 15 thereof by the height of a pitch, and the longitudinal drop faces 12, 22 of the two spiraling faces 11, 21 are brought into alignment again.

To illustrate the closing and opening of the invention, reference is made to FIGS. 11 to 14. First, referring to FIG. 13, the cap 1 is positioned by means of the threaded member 15 that engages the threaded portion 31 of the lower body 3. The upper and lower bodies 2, 3 are coupled integrally using high frequencies prior to assembling the cap 1. Therefore, assembly is completed after threaded engagement between the cap 1 and the threaded portion 31. As for the screw bolt 4, it is not used for threaded connection in this invention, and is merely used as a positioning element. In other words, it serves to limit the upward rotation of the cap 1. Hence, it can be substituted by any equivalent element such as a rivet or any element with a flange. As such, the screw bolt 4 is completely different from those used for threaded connection in the two prior art patents mentioned above.

Figure 13:
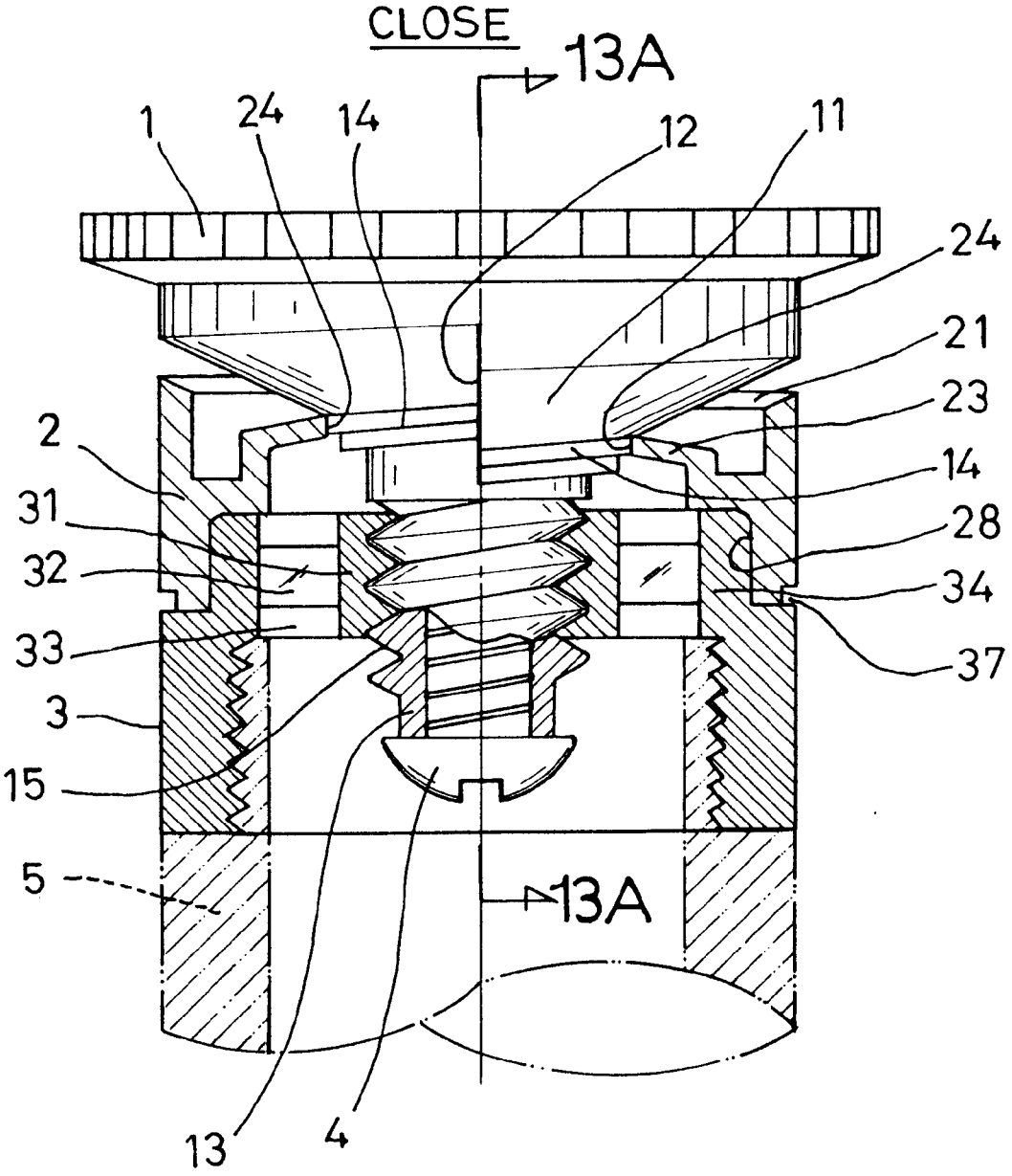
FIG. 13 is a sectional view of the invention after assembly, in the close state.
Figure 13A:
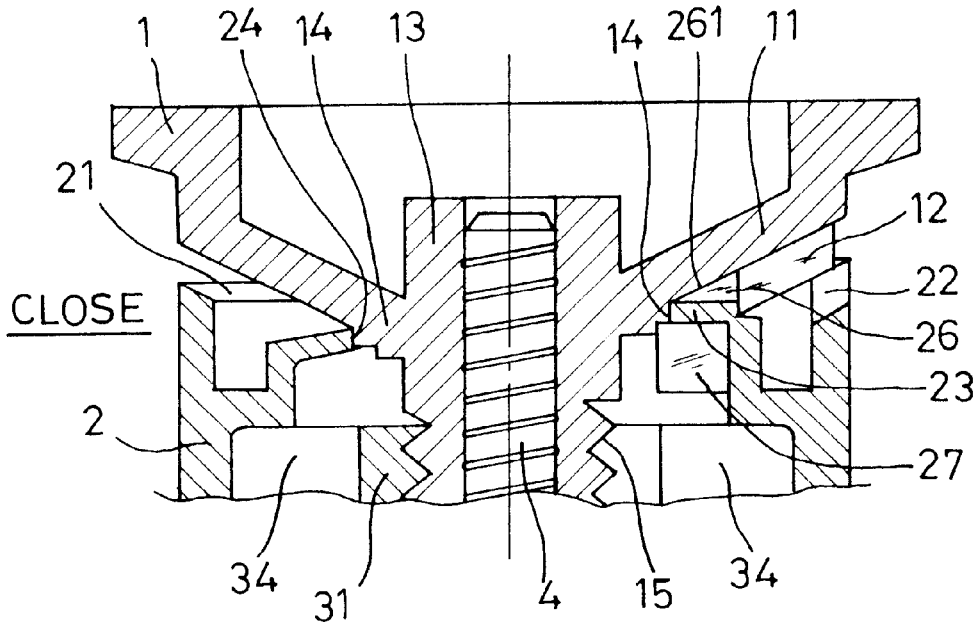
FIG. 13A is a sectional view taken along line 13A—13A of FIG. 13.

From FIG. 13, it can be seen that when the cap 1 is rotated downwardly to a close position, the stepped flange 14 of the first spiraling face 11 tightly abuts against the inner wall surface 24 of the second spiraling face 23 to complete stop the flow of water, thereby ensuring against water leakage. It can be seen from FIG. 13A that the longitudinal drop face 12 of the first spiraling face 11 just abuts against the first stop piece 26 of the third spiraling face 23, while the first spiral face 11 is still aligned with the longitudinal drop face 22 of the second spiraling face 21.

Figure 14A:
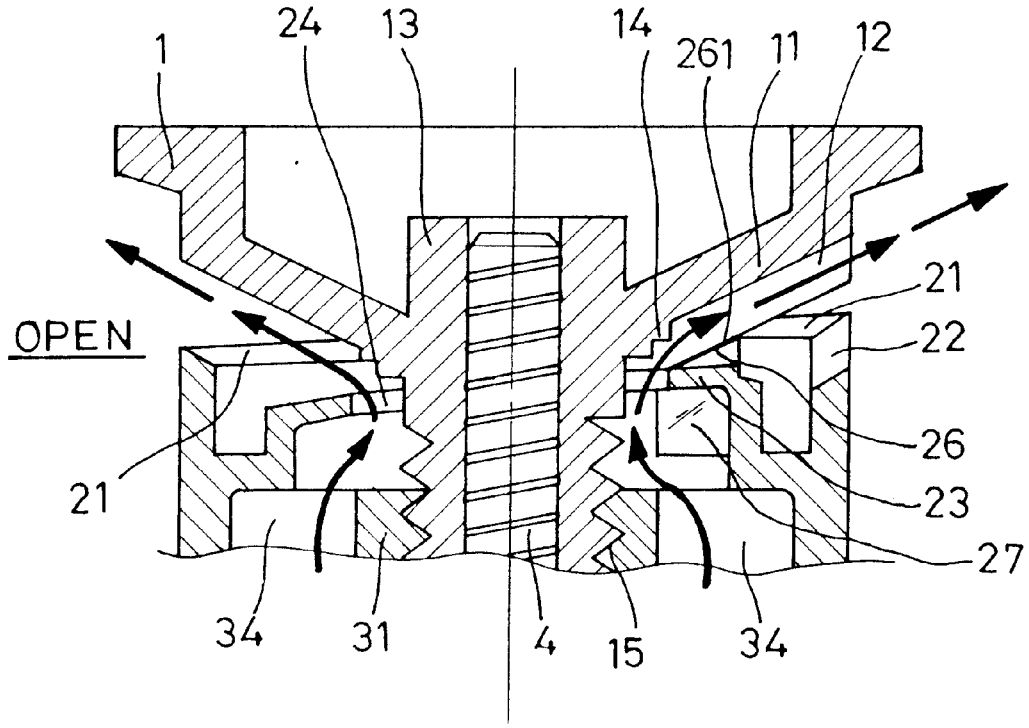
FIG. 14A is a sectional view taken along line 14A—14A of FIG. 14.
Figure 14:
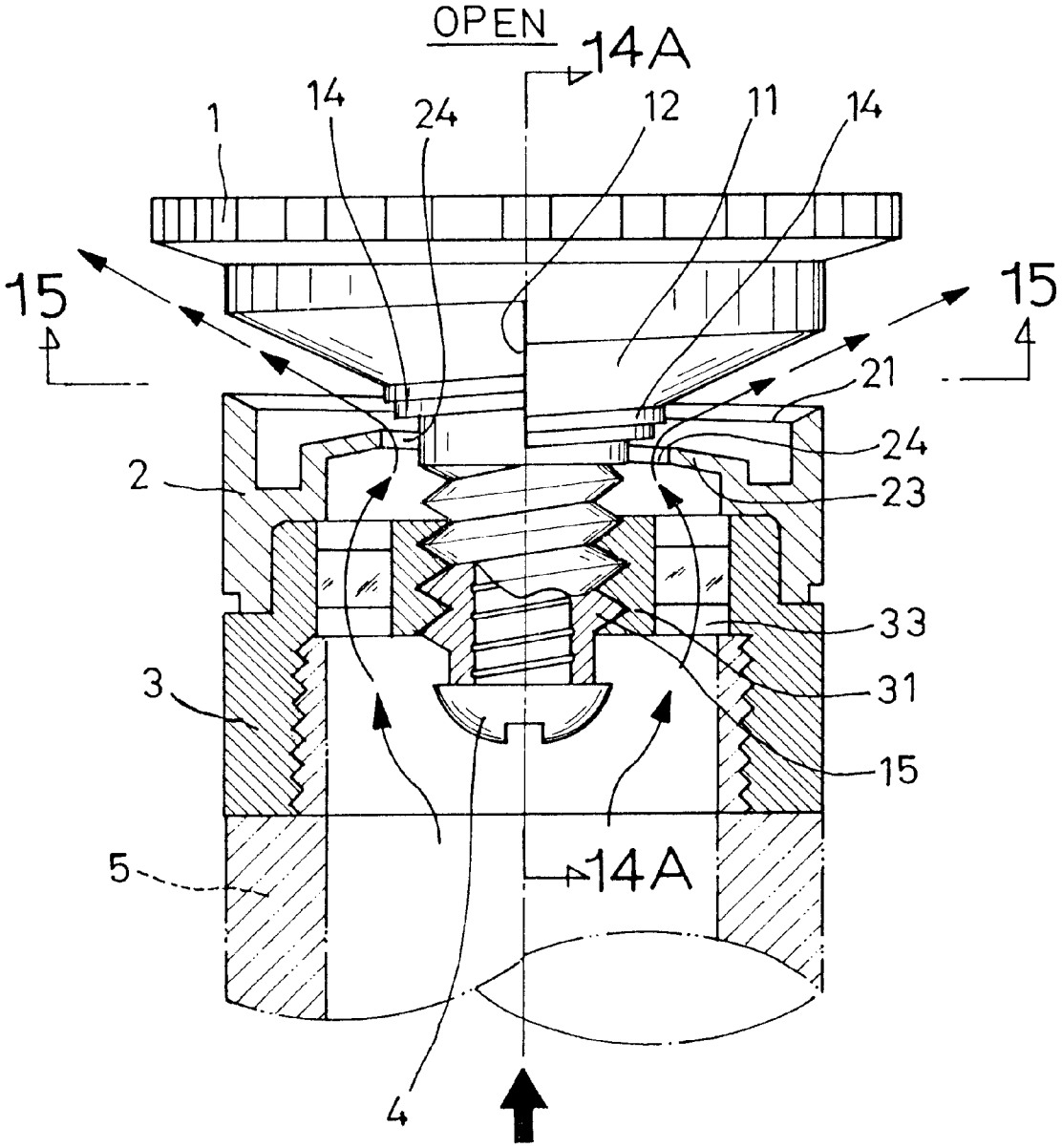
FIG. 14 is a sectional view of the invention after assembly, in the open state.
Figure 15:
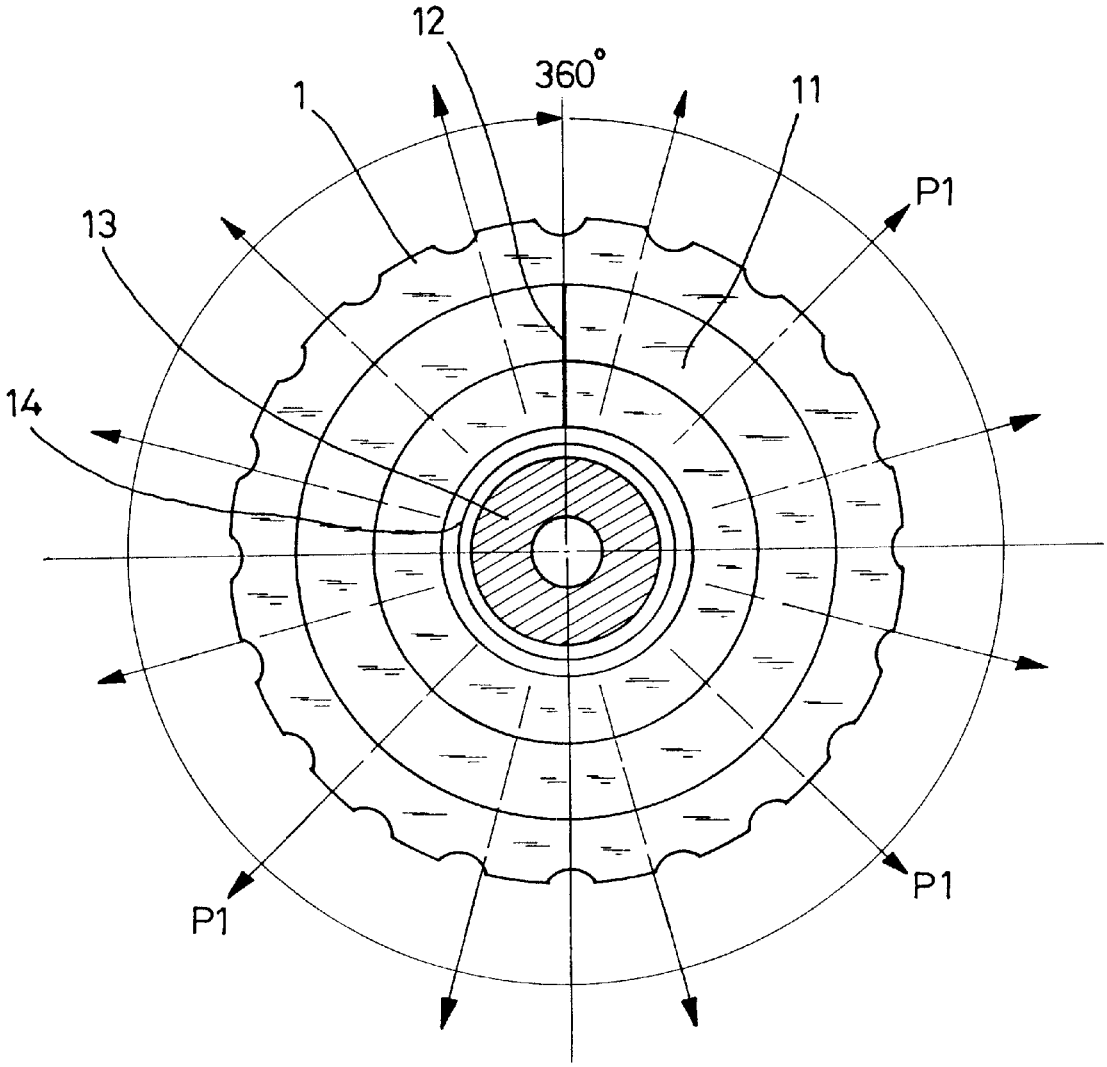
FIG. 15 is a schematic view taken along line 15—15 of FIG. 14.
Figure 16:
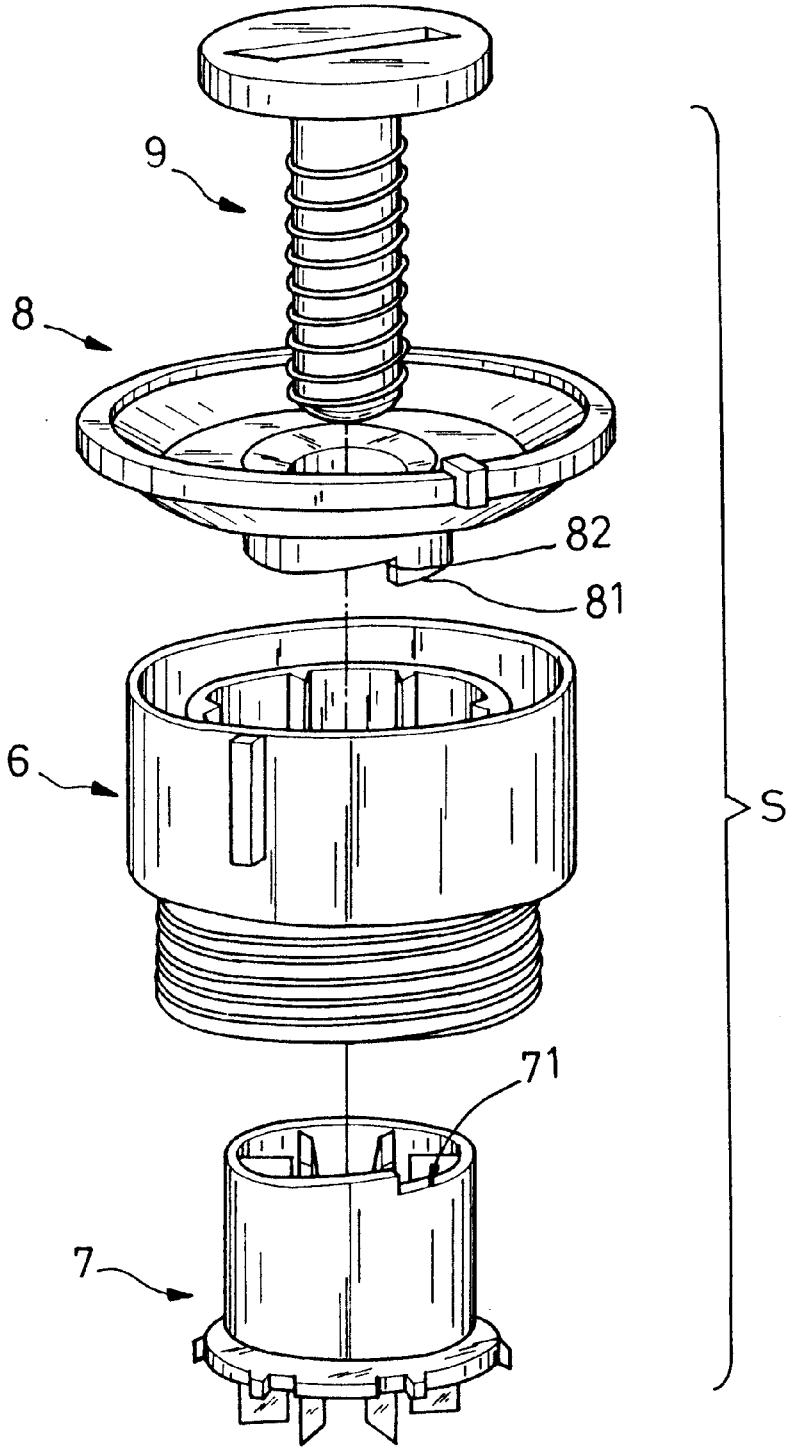
FIG.16 (PRIOR ART)
FIG. 16 is an exploded perspective view of U.S. Pat. No. 4,579,285.
Figure 17:
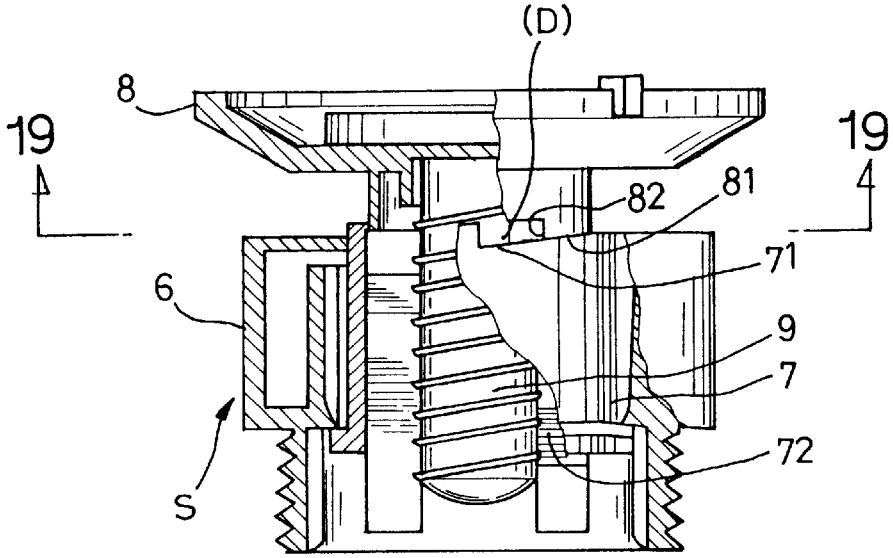
F I G.17 (PRIOR ART)
FIG. 17 is an assembled view of U.S. Pat. No. 4,579,285.
Figure 18:
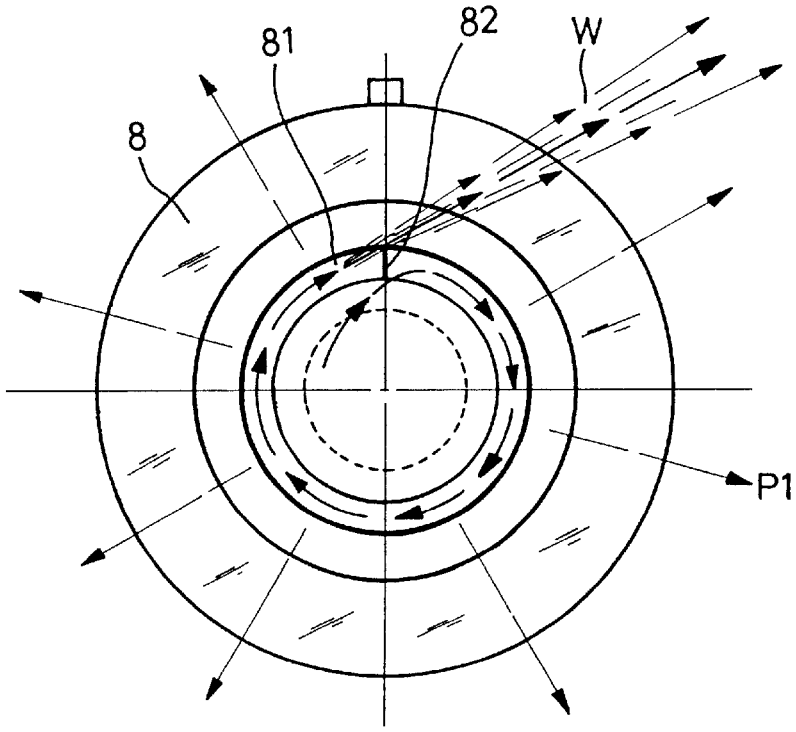
F I G.18 (PRIOR ART)
FIG. 18 is a schematic view illustrating operation of U.S. Pat. No. 4,579,285.
Figure 19:
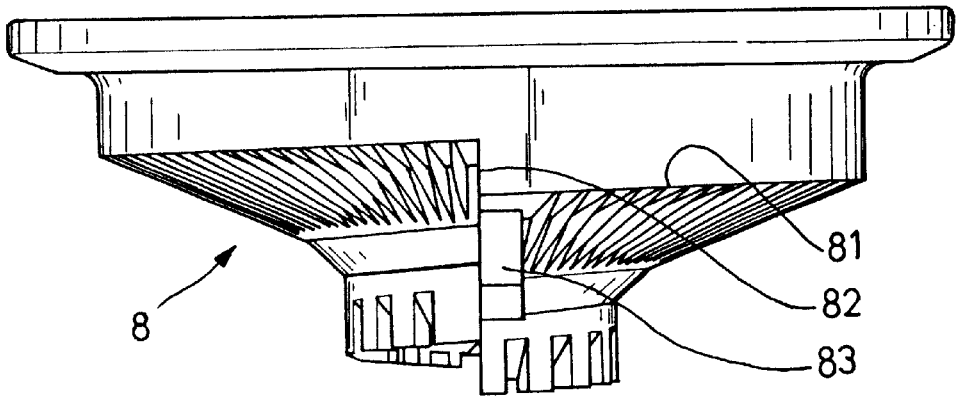
FIG. 19 (PRIOR ART)
FIG. 19 is a front elevation view of a cap member of U.S. Pat. No. 5,556,036.
Figure 20:
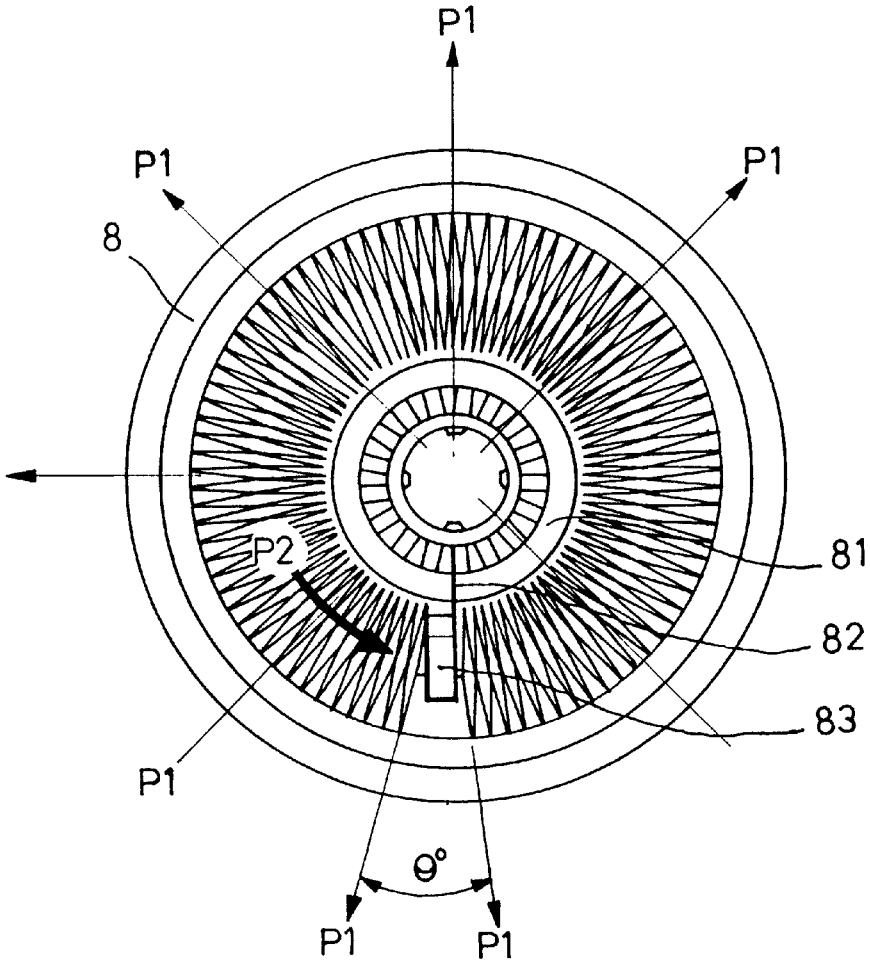
FIG. 20 (PRIOR ART)
FIG. 20 is a top view of the cap member of U.S. Pat. No. 5,556,036.

FIG. 14 shows that the threaded member 15 of the cap 1 is rotated 360 degrees upward along the threaded portion 31 to adjust a pitch. At this time, the stepped flange 14 at the bottom edge of the first spiraling face 11 disengages from the inner wall surface 24 of the third spiraling face 23 to form a nozzle orifice so that water can flow from a hose 5 threadedly engaging the inner threaded member 36 of the lower body 3 and upwardly to be sprayed to the surrounding via the nozzle orifice. At this time, it can be seen from FIG. 14A that the bottom edge of the longitudinal drop face 12 of the first spiraling face 11 is just located above and tangentially mates with the first stop piece 26 of the third spiraling face 23. That is, according to the invention, when the cap 1 rotates from 0 degree to 360 degrees, it elevates from the position in FIG. 13A to the position in FIG. 14A. therefore, the first stop piece 26 is configured to have the inclined face 261 that matches the first spiraling face 11, and the height thereof is just the height of a pitch of the threaded member 15 so that the first spiraling face 11 will not contact the first stop piece 26 after rotating 360 degrees and may just tangentially mate therewith so that the two longitudinal drop faces 12 and 22 are just in alignment. Such an arrangement is the major feature of this invention, and is distinct from the two prior patents. The advantage is that the first stop piece 26 is used to check the spiraling lateral force (the water current indicated by the arrow P2 in FIG. 20) of the water at the nozzle between the first and second spiraling faces 11, 23 so as to eliminate the drawback of the forming of a water column (W) at the longitudinal drop 82 of the spiraling face shown in FIG. 18. Furthermore, the first stop piece 26 is provided above the longitudinal drop face 26 of the third spiraling face 23, which is completely different from the arrangement of the spiraling face on the cap in U.S. Pat. No. 5,556,036 (as shown by the reference numeral 83) in FIGS. 19 and 20), wherein, due to the arrangement on the outer periphery of the longitudinal drop face 82 of the spiraling face 81, when the water is ejected via the nozzle orifice, a dead angle of θ degrees is formed. On the contrary, the invention does not suffer from this drawback. It can be clearly seen from FIG. 14A and FIG. 15 that when the cap 1 is rotated upwardly, and the nozzle orifice is opened, the so-called orifice referring to the space between the first spiraling face 11 and the third and second spiraling faces 23, 21. At this time, the lateral force of the water current is offset by the first stop piece 26, assisted by the second stop piece 27, so that the water current, as shown in FIG. 15, is sprayed in all directions at 360 degrees with the radial force (P1) from the bottom edge face of the cap 1, without formation of any dead angles. Hence, the present invention utilizes the first and second stop pieces 26, 27 of the third spiraling face 23 to improve the drawbacks associated with the lateral force with the spiraling water current and sprinkling dead angles.

Although the present invention has been illustrated and described with reference to the preferred embodiment thereof, it should be understood that it is in no way limited to the details of such embodiment but is capable of numerous modifications within the scope of the appended claims.

What is claimed is:

1. An adjustable sprinkler nozzle, comprising:

a cap having a bottom edge provided with a first spiraling face, formed at said bottom end of said cap, said first spiraling face having high and low curved faces spiraling about 360 degrees at a high plane and a low plane, respectively, and forming a first longitudinal drop face positioned at a joint extending between said high and low planes, said cap further having a bottom end thereof and a cylindrical tube positioned at said bottom end of said cap;

an upper body, contoured as a substantially hollow tube having an inner tubular wall, said upper body including a tubular wall having a bottom end and an upper edge, said upper edge being provided with a second spiraling face formed thereon and a second longitudinal drop face corresponding to said first longitudinal drop face of said first spiraling face;

a tubular lower body coupled to said bottom end of said upper body, said tubular lower body including a threaded portion extending centrally therethrough, a channel being formed between adjacent ones of said partitioning plates for passage of water; and a screw bolt inserted upwardly in said cylindrical tube at said bottom end of said cap and locked therein;

said cap further including a stepped projecting flange formed along a bottom edge of said first spiraling face and having an outer diameter thereof, said cylindrical tube being positioned at said bottom end of said cap and having a threaded outer surface forming a threaded member threadingly coupled with said threaded portion of said lower body;

said tubular wall of said upper body further including a third spiraling face formed in proximity to an upper end face of said upper body, said third spiraling face corresponding to said second spiraling face and having an inner diameter engaging with said outer diameter of said stepped projecting flange of said cap, said third spiraling face having an inner wall surface and a third longitudinal drop face formed at a joint between a high and a low planes of said third spiraling face, said third longitudinal drop face having a first stop piece extending upwardly from a highest point of said third spiraling face, said stop piece being inwardly provided with an inclined face, said inner wall surface of said third spiraling face being provided with a second stop piece corresponding to the position of said first stop piece, said inner tubular wall of said upper body being provided with a positioning projecting block located at a predetermined position of said inner tubular wall;

said tubular lower body including an upper end portion thereof having a raised annular portion engaged into said inner tubular wall of said upper body, a bottom edge of said annular portion having a fine annular rib adapted for fusion using high frequencies, said annular portion further having a groove formed at a predetermined position thereof for engaging with said positioning projecting block of said upper body, said tubular wall of said upper body being provided with a threaded member; and said screw bolt being locked within said cylindrical tube of said cap and being rotatable on said threaded portion with said threaded member.

* * * * *